US010378741B2

(12) United States Patent
Borgeson

(10) Patent No.: US 10,378,741 B2
(45) **Date of Patent: *Aug. 13, 2019**

(54) LIGHT WITH PRE-WIRED ELECTRIC WIRE LOOP

(71) Applicant: The Toro Company, Bloomington, MN (US)

(72) Inventor: Michael Borgeson, Wildomar, CA (US)

(73) Assignee: The Toro Company, Bloomington, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/052,583

(22) Filed: Aug. 1, 2018

(65) Prior Publication Data

US 2019/0101272 A1 Apr. 4, 2019

Related U.S. Application Data

(63) Continuation of application No. 15/880,427, filed on Jan. 25, 2018, now Pat. No. 10,060,610.

(60) Provisional application No. 62/567,913, filed on Oct. 4, 2017.

(51) Int. Cl.

| | |
|---|---|
| ***H01B 7/36*** | (2006.01) |
| ***F21V 23/00*** | (2015.01) |
| ***F21Y 115/10*** | (2016.01) |
| ***F21W 131/107*** | (2006.01) |

(52) U.S. Cl.

CPC ..... *F21V 23/001* (2013.01); *H01B 7/365* (2013.01); *F21W 2131/107* (2013.01); *F21Y 2115/10* (2016.08)

(58) Field of Classification Search

CPC ..... F21V 12/001; F21V 23/06; F21V 23/001; H01B 7/365; F21W 2131/107; F21Y 2115/10; Y02B 20/383; Y02B 20/386; F21K 9/27; F21S 8/00

See application file for complete search history.

(56) References Cited

U.S. PATENT DOCUMENTS

| | | | |
|---|---|---|---|
| 3,740,541 | A | 6/1973 | Conradt |
| 4,814,961 | A | 3/1989 | O'Brien et al. |
| 4,870,548 | A | 9/1989 | Beachy et al. |
| 4,937,499 | A | 6/1990 | Hunte |
| 5,113,325 | A | 5/1992 | Eisenbraun |
| 5,463,540 | A | 10/1995 | Jones |
| 6,004,154 | A | 12/1999 | O'Brien |
| 6,093,051 | A | 7/2000 | O'Brien |
| 6,502,967 | B2 | 1/2003 | Mullen |
| 6,830,362 | B2 | 12/2004 | Mullen |
| 6,860,624 | B2 | 3/2005 | Hille et al. |
| 7,018,077 | B2 | 3/2006 | Mullen |
| 7,021,787 | B1 | 4/2006 | Kuelbs |
| 7,063,553 | B1 | 6/2006 | Mullen |
| 7,063,555 | B1 | 6/2006 | Mullen |

(Continued)

*Primary Examiner* — Peggy A Neils

(74) *Attorney, Agent, or Firm* — Inskeep IP Group, Inc.

(57) ABSTRACT

A lighting assembly is disclosed that is sold in a kit/package with a single, dual conductor wire that forms an electrical "loop". Both free ends of a first conductor of the wire are connected to the same conductor socket and both free ends of a second conductor are connected to the other conductor socket. During installation, a contractor can simply cut with wire loop to provide a pre-wired light assembly that is ready to be daisy-chained to other light assemblies or electrical equipment.

17 Claims, 8 Drawing Sheets

(56) References Cited

U.S. PATENT DOCUMENTS

| | | | | |
|---|---|---|---|---|
| 7,213,961 | B2 | 5/2007 | Hyder | |
| 7,699,481 | B2 | 4/2010 | Mullen | |
| 8,234,304 | B2 | 7/2012 | Holcombe et al. | |
| 8,502,454 | B2 | 8/2013 | Sadwick | |
| 8,864,333 | B2 | 10/2014 | Burkart et al. | |
| 10,006,596 | B2 * | 6/2018 | Yu | F21S 10/023 |
| 10,060,610 | B1 * | 8/2018 | Borgeson | H01B 7/365 |
| 2003/0193811 | A1 | 10/2003 | Mullen | |
| 2012/0146536 | A1 | 6/2012 | Mullen et al. | |
| 2013/0010461 | A1 | 1/2013 | Wilson | |

* cited by examiner

LIGHT WITH PRE-WIRED ELECTRIC WIRE LOOP

RELATED APPLICATIONS

This application is a continuation of and claims priority to U.S. patent application Ser. No. 15/880,427 filed Jan. 25, 2018 entitled Light With Pre-Wired Electric Wire Loop, which claims priority to U.S. Provisional Application Ser. No. 62/567,913 filed Oct. 4, 2017 entitled Light With Pre-Wired Electric Wire Loop, both of which are hereby incorporated herein by reference in their entireties.

BACKGROUND OF THE INVENTION

Outdoor lighting can be used to illuminate various spaces outside of a home, business, or other building. Typically, low voltage lights are used for such lighting, requiring them to be wired to a transformer that transforms the higher voltage AC power (e.g., 120 VAC) to low voltage AC power (e.g., 12-22 VAC) that can be used by the lighting. While low voltage AC power is typically used for such installations, transforming the higher voltage to low voltage DC power is also possible for lighting systems.

There are different methods of wiring these lights as noted in U.S. Pat. No. RE45143, which is hereby incorporated in its entirety. This includes using an electrical "hub" that helps maintain equal amounts of voltage are provided to each of the wires connected to it.

Typically, when an outdoor light is purchased (for example, any of the outdoor lights shown in U.S. application Ser. No. 15/729,538 which is incorporated by reference), no wires are connected to its light bulb socket assembly. Hence, a contractor must at least connect one dual conductor wire to each of the sockets, thereby allowing several lights to be "daisy chained" together. Since these sockets are located within the outer light casing, the entire light assembly must generally be disassembled to complete the wiring. This can be a time-consuming process. Therefore, what is needed is a technique that decreases the installation time and effort needed for an outdoor lighting system.

SUMMARY OF THE INVENTION

The present invention is directed to a lighting assembly that is sold in a kit/package with a single, dual conductor wire (e.g., 20 ft or 25 ft) that forms an electrical "loop". More specifically, both free ends of a first conductor of the wire are connected to the same conductor socket and both free ends of a second conductor are connected to the other conductor socket.

During installation, the contractor can choose a location on the wire loop to cut to create the necessary lengths of wire for the lighting system installation. Once cut, the ends of the wires can be easily and quickly connected to wires of an adjacent light assembly or to an equalizer hub or transformer.

In one embodiment, the wire loop includes a plurality of measuring markers or indicia spaced at regular lengths (e.g., every foot of the wire). These markers may include printed text indicated the length of the marker from one end of the wire (e.g., 5 ft). These indicia help the installation contractor more quickly determine where on the wire loop should be cut so as to be the proper length to reach the next connection point.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which"

DESCRIPTION OF EMBODIMENTS

Figure 1:
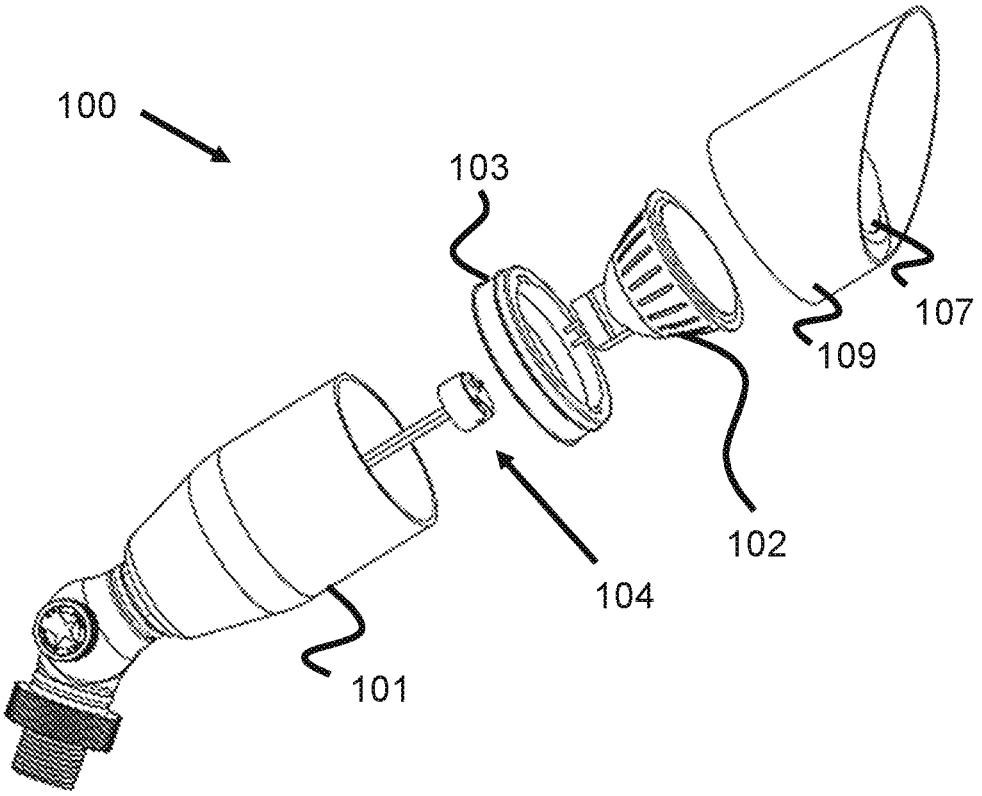
FIG. 1 is an exploded view of a lamp according to the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

FIG. 1 illustrates an example lamp or outdoor lighting assembly 100 having an outer light casing 101. Inside the casing 101 is a light bulb socket assembly 104 that provides an electrical connection for the electrical contacts of a light bulb 102 (e.g., a LED bulb). The bulb 102 is mounted via a gasket 103 that is positioned on the top of the casing 101. A light hood 109 is connected on the gasket 103 and further includes a lens 107 that helps protect the bulb 102 and socket assembly 104 from elements.

Figure 2:
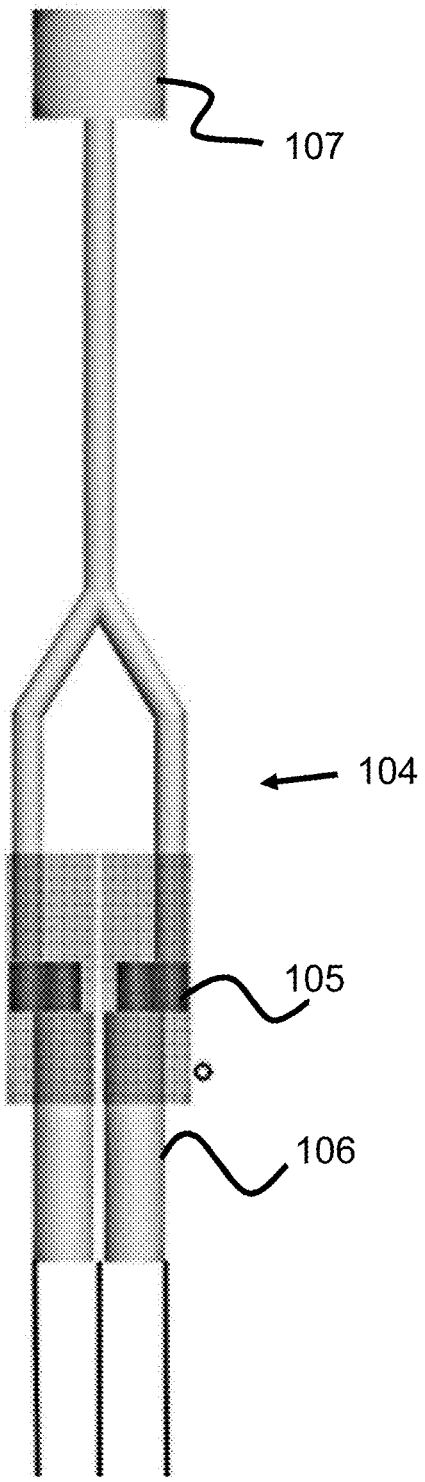
FIG. 2 is a light bulb socket assembly of a lamp according to the present invention.

As seen in FIG. 2, the light bulb socket assembly 104 typically includes a bulb socket 107 which provides the female electrical contacts that connect to the male electrical contacts of the bulb 102. The assembly 104 also has a wire extending from it that branches into two wire sockets 105, each of which can be connected to one conductor of a dual conductor wire 106. Typically, a dual conductor wire 106 is a single insulated wire that has two separate, electrically isolated conductive paths or conductive wires in it.

Typically, when a lighting assembly 100 is purchased, no wires are connected to its light bulb socket assembly 104. Hence, a contractor must at least connect one dual conductor wire to each of the sockets 105. Since these sockets 105 are located within the outer light casing 101, the entire light assembly 100 must generally be disassembled and reassembled to complete the wiring. This can be a time-consuming process.

Often, some or all of the light bulb assemblies 100 are wired in a daisy chain, such that both of the conductor sockets 105 are connected to both of the conductor sockets 105 of an adjacent bulb assembly 100, creating an electrical chain. In other words, each of the socket assemblies 104 have two different dual conductor wires 106 connected (two conductors from two different wires in each socket 105). Typically, a contractor will determine a desired length of electrical wire 106 to connect adjacent bulbs assemblies 100 and then will cut and attach these wire lengths as needed.

Figure 3:
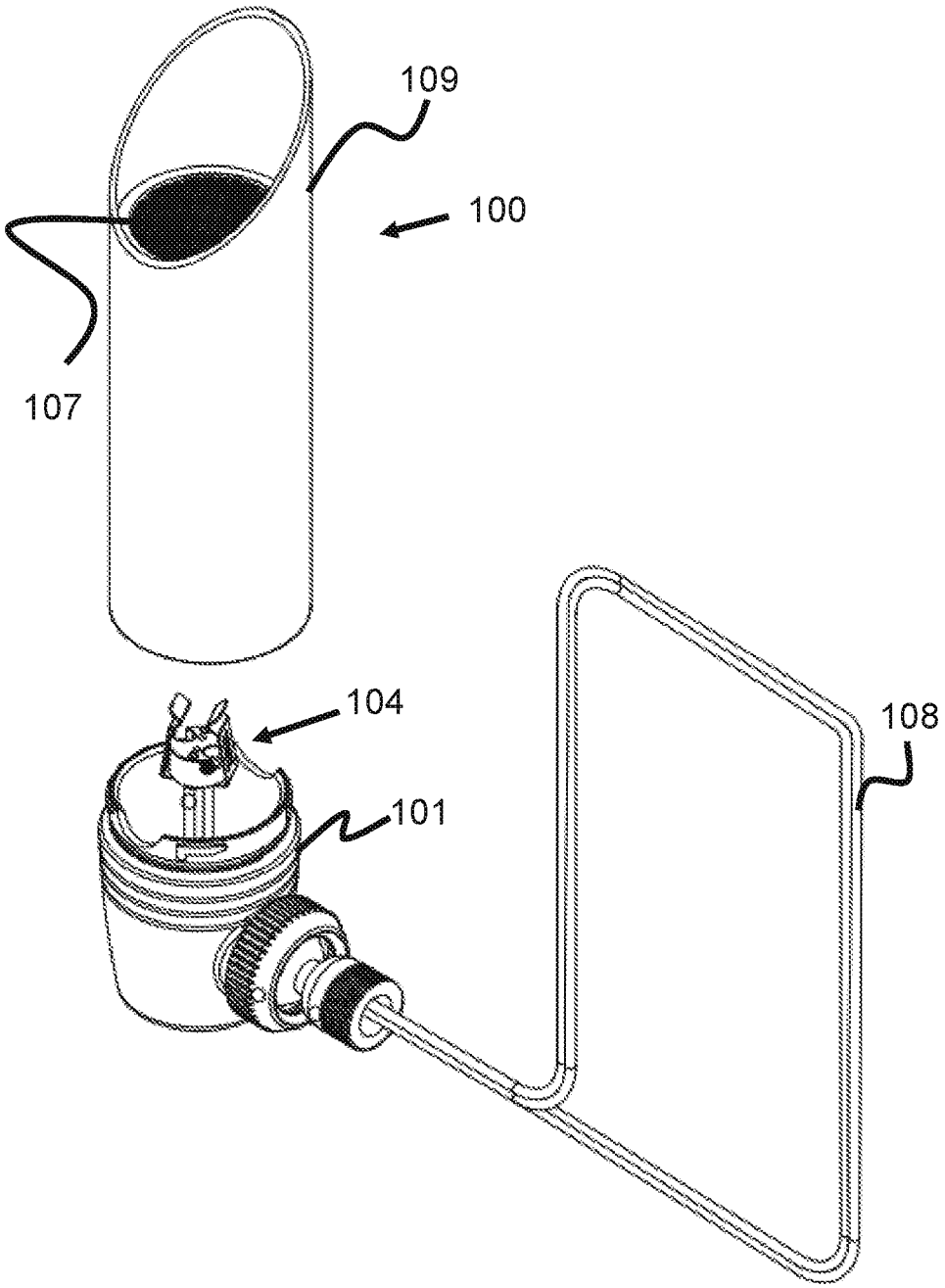
FIG. 3 is a lamp with a loop of wire connected to is according to the present invention.
Figure 4:
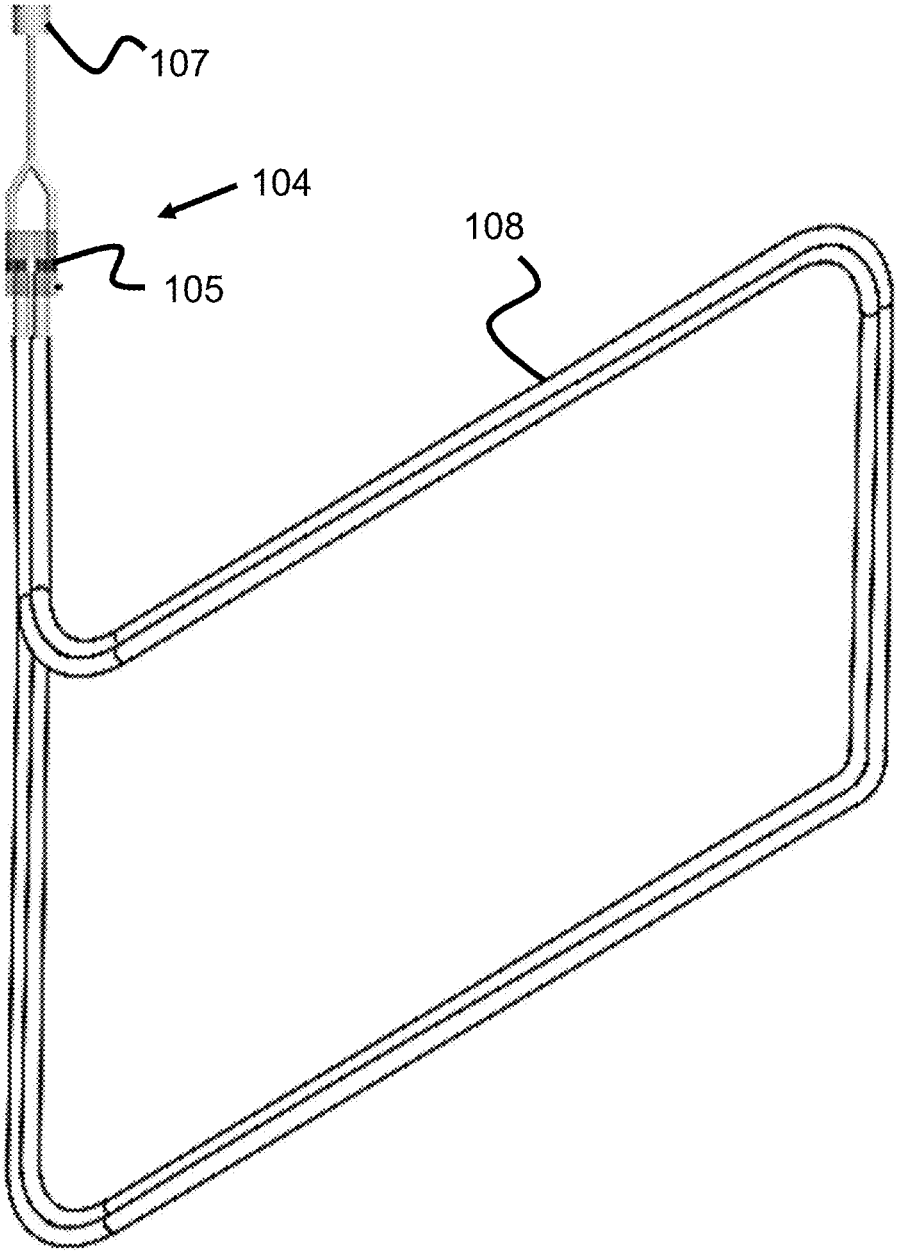
FIG. 4 a light bulb socket assembly with a loop of wire connected to it according to the present invention.
Figure 5:
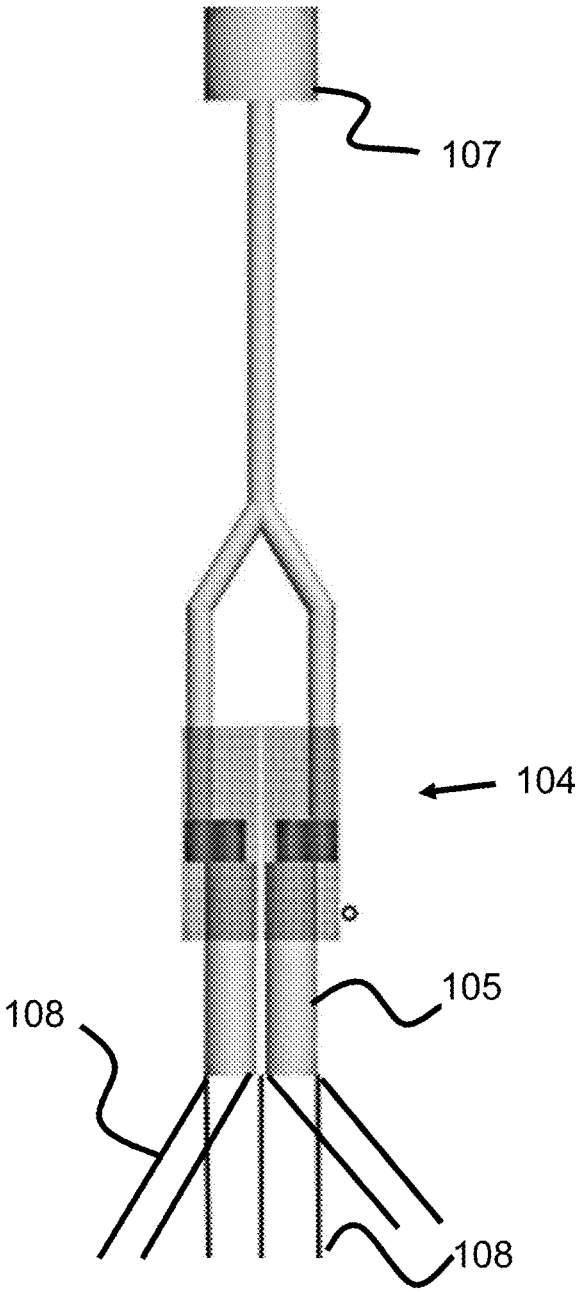
FIG. 5 a light bulb socket assembly with a loop of wire connected to it according to the present invention.

FIG. 3 illustrates a lighting assembly 100 that is sold as a kit with a single, dual conductor wire 108 (e.g., 20 ft or 25 ft long) that forms a loop. More specifically, both free ends of a first conductor of the wire 108 are connected to the same conductor socket 105, while both free ends of a second conductor of the wire are connected to the other conductor socket 105, as best seen in FIGS. 4 and 5. Hence, the sockets 105 each connect to three wire ends (two from opposite ends of the dual conductor wire 108 and one leading to the bulb socket 107.

Figure 6:
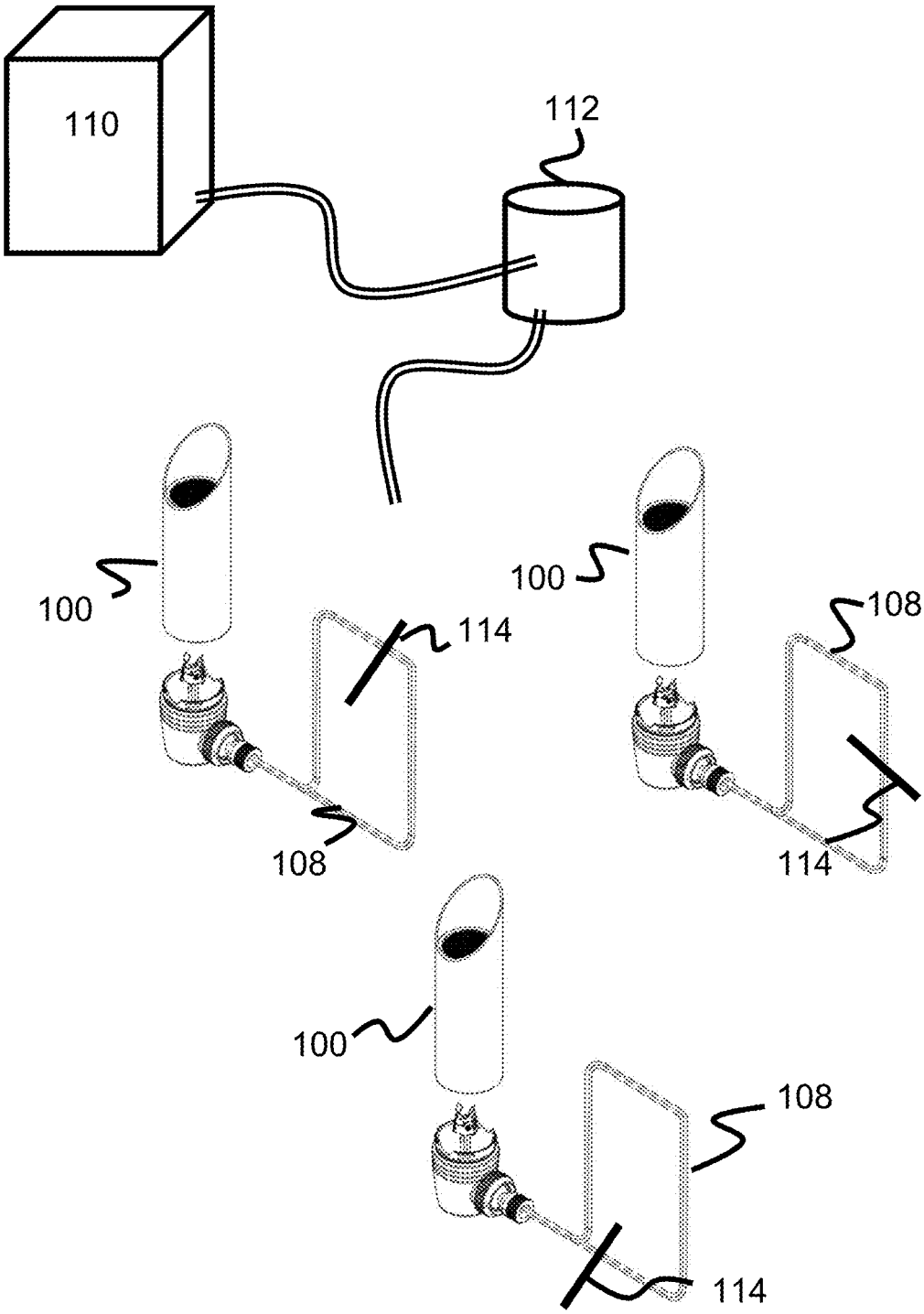
FIG. 6 is a light system with a plurality of lights that have not yet been electrically connected to each other, according to the present invention.
Figure 7:
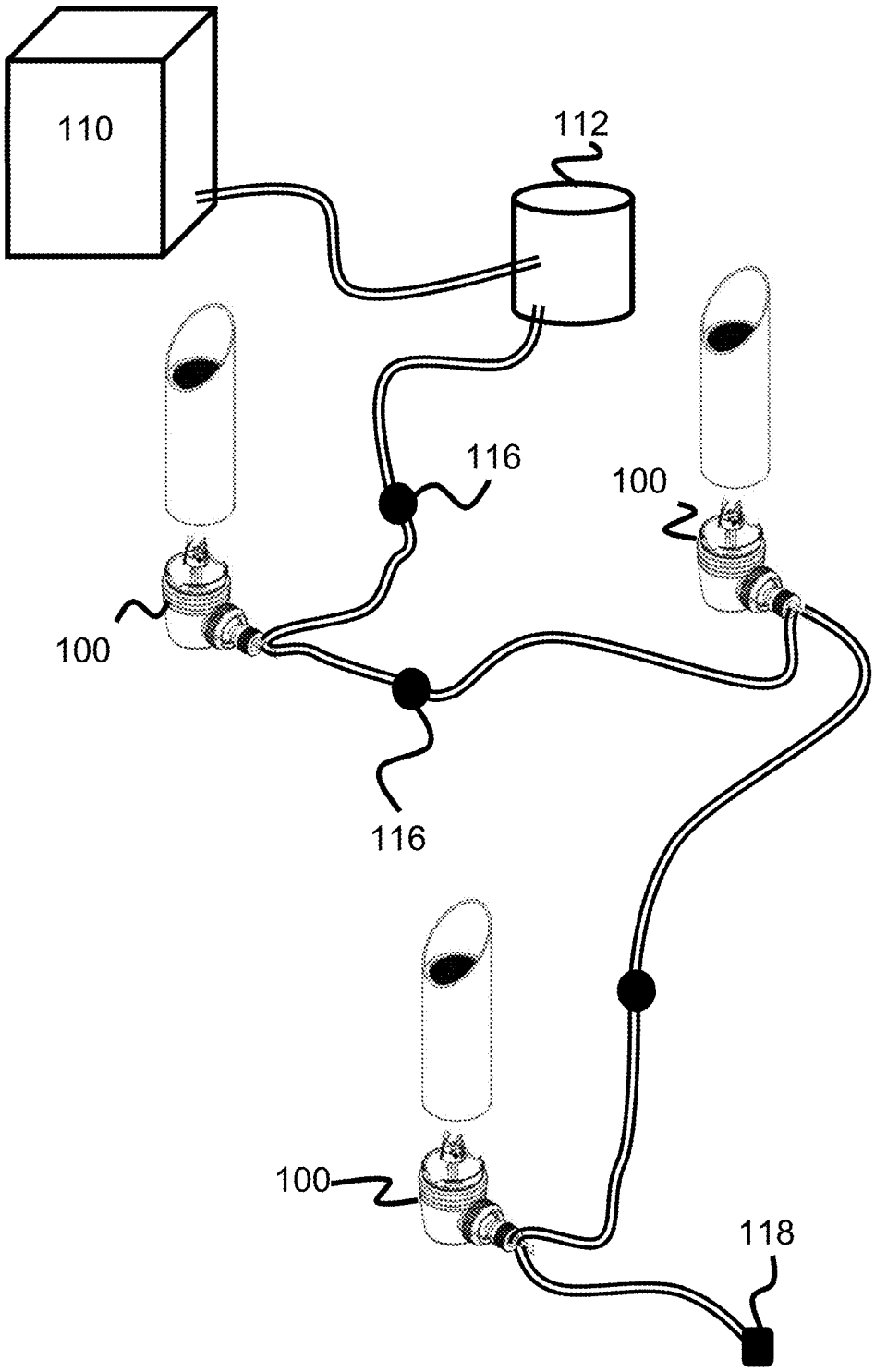
FIG. 7 is a light system with a plurality of lights that have been connected to each other, according to the present invention.

The lighting assembly 100 with the pre-attached loop 108 is sold to the contractor in that state, as a lighting "kit". During installation, the contractor can choose a location on the wire loop 108 to cut to create the necessary lengths of wire for the lighting system installation. Once cut, the ends of the wires 108 can be easily and quickly connected to wires of an adjacent light assembly 100 or to an equalizer hub 112 or transformer 110. This type of installation in a daisy chain configuration can be seen in FIG. 6 (where the wires are cut at locations 114) and connected to each other at locations 116, as seen in FIG. 7.

For example, the contractor could cut a 20 ft loop of wire in the middle to create two, pre-attached 10 ft wires. In another example, the contractor could cut a 20 ft loop near one end to create a pre-attached 5 ft wire and a pre-attached 15 ft wire. In this respect, the time-consuming processes of measuring a wire, cutting the wire, stripping both ends of the wire, opening up each lighting assembly 100, and attaching the wire is eliminated. The contractor need only to cut the loop 108, strip the ends of the remaining wires 108, and then quickly connect the wires to other wires in the system.

Figure 8:
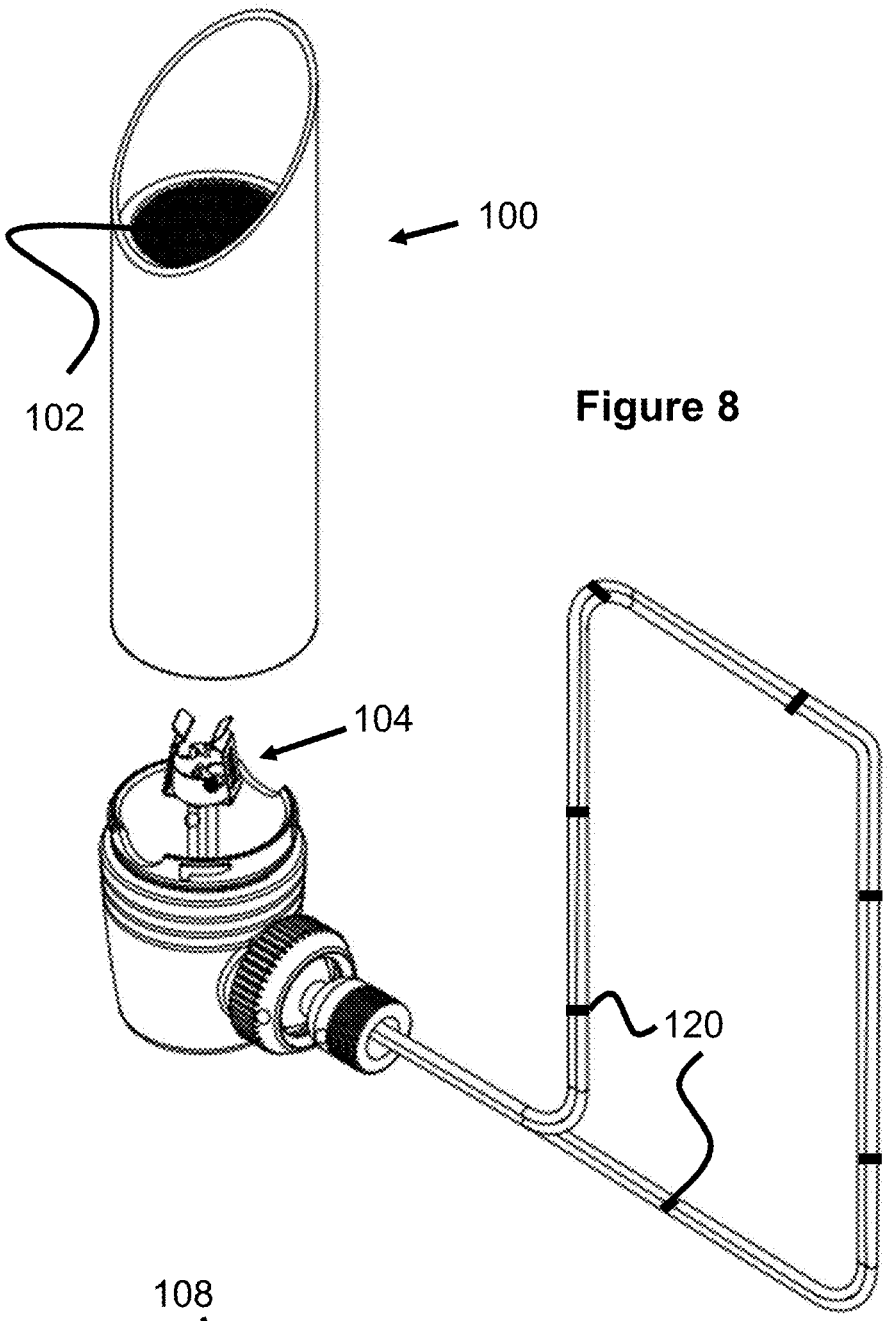
FIG. 8 illustrates a lamp with a loop of electrical wire connected to it, having a plurality of length indicators on it, according to the present invention.
Figure 9:
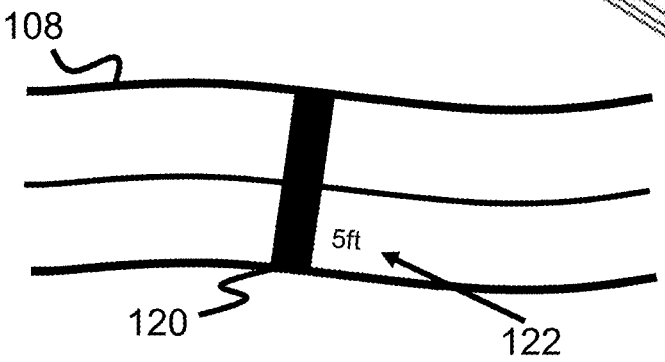
FIG. 9 illustrates a magnified view of the indicator of FIG. 8.

While it is possible for the contractor to measure the wire 108 to determine exactly where the loop should be cut, another embodiment shown in FIGS. 8 and 9 illustrate length markers 120 and length indicia 122 spaced out at regular, pre-measured locations. For example, the markers 120 may be space at 1 ft intervals and the indicia 122 may count upwards from one end of the wire. In this respect, the contract does not need to use a separate measuring tool to determine where to cut the loop and only needs to read the appropriate indicia 122 on the wire. Preferably, the markers/indicia begin at the location that the wire 108 exits the lighting assembly 100 and not from the socket assembly 104. This start location may provide the contractor with a more accurate length indication from the light assembly 100 as a whole, which may be more desirable, rather than from a location within the light assembly 100.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A light assembly kit comprising:

a light casing;

a light bulb located within said casing housing;

a light socket assembly connected to said light bulb and located in said light casing housing; and, a dual conductor electrical wire; said dual conductor electrical wire comprising a first end having a first electrical conductor end and a second electrical conductor end, and a second end having a third electrical conductor end and a fourth electrical conductor end;

wherein said first electrical conductor end and said third electrical end are connected to a first electrical connector of said light socket assembly; and wherein said second electrical conductor end and said fourth electrical conductor end are connected to a second electrical connector of said light socket assembly; thereby forming a loop with said dual conductor electrical wire located at least partially out of said light casing.

2. The light assembly kit of claim 1, wherein said light bulb is an LED light bulb.

3. The light assembly kit of claim 1, wherein said light casing comprises a hood that connects to said light casing.

4. The light assembly kit of claim 3, wherein said hood further comprises a lens.

5. The light assembly kit of claim 4, further comprising a gasket supporting said light bulb.

6. The light assembly kit of claim 1, wherein said dual conductor electrical wire further comprises a plurality of markers spaced at regular intervals along a length of said dual conductor electrical wire.

7. The light assembly kit of claim 6, wherein said dual conductor electrical wire further comprises a plurality of length indicia that are each positioned near on of said plurality of markers; said plurality of length indicia incrementally communicating a distance between said plurality of markers.

8. The light assembly kit of claim 7, wherein said plurality of length indicia begin incrementally increasing starting from an exterior of said light casing.

9. A light assembly kit comprising:

a light casing;

a light socket assembly having a light bulb socket connectable to a light bulb, said light socket assembly being located in said light casing; and, a dual conductor electrical wire having a continuous portion forming a loop with two conductive paths terminating with a first end and a second end, both of the first end and the second end are electrically connected to said light socket assembly so as to form said loop, at least part of which is positioned outside of said light casing, wherein during installation the wire loop is cut to create the necessary lengths of wire for installation of the light assembly.

10. The light assembly kit of claim 9, wherein said light socket assembly has a first electrical connector and a second electrical connector; and wherein a first end of said dual conductor electrical wire is connected to said light socket assembly and a second end of said dual conductor electrical wire is connected to said light socket assembly.

11. The light assembly kit of claim 9, further comprising a light bulb connected to said light socket.

12. The light assembly kit of claim 9, further comprising a hood containing a lens.

13. The light assembly kit of claim 9, further comprising a plurality of length markers disposed on said dual conductor electrical wire.

14. The light assembly kit of claim 9, further comprising a plurality of length indicia disposed on said dual conductor electrical wire.

15. A method of installing a light assembly kit, comprising:

obtaining a first light assembly kit comprising a light housing; a light socket assembly having a light bulb socket located in said light housing; and a first dual conductor electrical wire having a first end and a second end, both of which that are electrically connected to said light socket assembly so as to form a loop at least partially positioned outside of said light housing;

cutting said loop of said first dual conductor electrical wire and connecting a newly-created third end to a second dual conductor electrical wire of a second light assembly kit.

16. The method of claim 12, further comprising connecting a newly-created fourth end of said dual conductor electrical wire to a third dual conductor electrical wire of a third light assembly kit.

17. The method of claim 12, further comprising connecting a newly-created fourth end of said dual conductor electrical wire to an equalizer hub.

* * * * *